US008282295B2

(12) United States Patent
Chen

(10) Patent No.: US 8,282,295 B2
(45) Date of Patent: Oct. 9, 2012

(54) LABEL SHEET POSITIONING DEVICE OF BARCODE PRINTER

(75) Inventor: Ching-Wen Chen, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 855 days.

(21) Appl. No.: 12/318,715

(22) Filed: Jan. 7, 2009

(65) Prior Publication Data

US 2009/0174132 A1 Jul. 9, 2009

(30) Foreign Application Priority Data

Jan. 7, 2008 (TW) ..... 97200328 U

(51) Int. Cl.
*B41J 2/27* (2006.01)

(52) U.S. Cl. ..... 400/120.17

(58) Field of Classification Search ..... 400/120.17
See application file for complete search history.

(56) References Cited

U.S. PATENT DOCUMENTS

| | | | | |
|---|---|---|---|---|
| 4,527,472 | A * | 7/1985 | Davison | 101/219 |
| 5,733,054 | A * | 3/1998 | Miazga | 400/120.17 |
| 2004/0005181 | A1* | 1/2004 | Liu | 400/175 |
| 2005/0237371 | A1* | 10/2005 | Danta | 347/103 |
| 2005/0271441 | A1* | 12/2005 | Bouverie et al. | 400/234 |

* cited by examiner

*Primary Examiner* — Daniel Hess
*Assistant Examiner* — David Tardif
(74) *Attorney, Agent, or Firm* — Rosenberg, Klein & Lee

(57) ABSTRACT

A label sheet positioning device is provided for a barcode printer, including a pressure regulation seat having two pressure adjusting knobs and at least one universal adjusting knob mounted to a top thereof. The pressure adjusting knobs serve to adjust pressure for positioning in the upward-downward direction of a label sheet of the barcode printer. The universal adjusting knob functions to realize fine adjustment of pressure for positioning in a universal adjustable manner that the pressure regulation seat applies to the label sheet. At least one universal adjusting mechanism is coupled to bottom of the pressure regulation seat for effecting adjustment of inclination direction by the universal adjustment realized by the universal adjusting knob. At least one printing head holder is coupled to a front portion of the universal adjusting mechanism and has a bottom coupled to a printing head, whereby the printing head holder is subjected to adjustment of pressure in upward-onward direction by the pressure adjusting knobs of the pressure regulation seat and is also subjected to fine adjustment of inclination direction by the adjustment that the universal adjusting knob applies to the universal adjusting mechanism to effect universal fine adjustment for the printing head holder and the printing head in order to ensure tight engagement of the printing head with respect to the label sheet of the barcode printer. Thus, a label sheet positioning device featuring universal fine adjustment of inclination direction is provided.

8 Claims, 9 Drawing Sheets

LABEL SHEET POSITIONING DEVICE OF BARCODE PRINTER

BACKGROUND OF THE INVENTION

1. Field of the Invention

The present invention relates to a label sheet positioning device of a barcode printer, and in particular to a label sheet positioning device that is applicable to a barcode printer to provide inclining of a printing head holder and a printing head for close engagement with a label sheet by means of a universal fine adjustment mechanism.

2. The Related Arts

A conventional barcode printer contains a label sheet which is contained inside the barcode printer for printing thereon barcodes by the operation of a printing mechanism and then out-fed. To control the printing precision of the label sheet, a mechanism for regulation upper and lower side pressures must be provided in the barcode printer for the label sheet to ensure closeness or tightness between the label sheet and the printing head. FIG. 1 of the attached drawings shows a conventional pressure regulation mechanism 1A of a barcode printer 1, which includes two pressure adjusting knobs 2, 3 that effect direct downward depression for adjusting the tightness of engagement and pressure of a printing head 4 that is located below the pressure regulation mechanism 1A with respect to a label sheet 5 and thereby adjusting printing quality of the printing head 4 applying to the label sheet 5.

In the structure of the pressure regulation mechanism 1A of the barcode printer 1 shown in FIG. 1, when the width of the label sheet 5 is identical to or close to the distance between the two pressure adjusting knobs 2, 3, the adjustment of the pressure and tightness between the label sheet 5 and the printing head 4 can be properly done. However, for a label sheet 5 having a reduced width, such as a small-size label sheet 5 having only a quarter of the original sheet width, it is no longer possible to effect proper pressure adjustment for ensuring tight or close engagement between the printing head 4 and the label sheet 5 by simply operating the two pressure adjusting knobs 2, 3 of the pressure regulation mechanism 1A with respect to the label sheet 5. Very likely, an unbalance of pressure may occur, causing inclination at one end between the label sheet 5 and printing head 4, and thus making the printing result on the label sheet 5 unclear or leading to deterioration of printing quality.

Further, if different designs of the pressure regulation mechanism 1A and the pressure adjusting knobs 2, 3 are given for different widths of the label sheet 5, then the manufacturing costs are increased. Further, in case that the inclination between the label sheet 5 and the printing head 4 is toward the front-rear direction, or other directions rather than the left-right direction, then the conventional structures of the pressure regulation mechanism 1A and the pressure adjusting knobs 2, 3 cannot ensure tight or close engagement between the label sheet 5 and the printing head 4 and proper printing on the label sheet 5. This makes the conventional barcode printer 1 adverse to the development of the industry.

SUMMARY OF THE INVENTION

Thus, in view of the above discussed problems, the present invention is aimed to provide a label sheet positioning device for a barcode printer in order to solve the above problems that multiple-angle adjustment and tight engagement cannot be realized between a printing head and label sheets of various widths.

To achieve the above goal, in accordance with the present invention, a label sheet positioning device is provided for a barcode printer and comprises a pressure regulation seat comprising two pressure adjusting knobs and at least one universal adjusting knob mounted to a top thereof. The pressure adjusting knobs serve to adjust pressure for positioning in the upward-downward direction of a label sheet of the barcode printer. The universal adjusting knob functions to realize fine adjustment of pressure for positioning in a universal adjustable manner that the pressure regulation seat applies to the label sheet. At least one universal adjusting mechanism is coupled to bottom of the pressure regulation seat for effecting adjustment of inclination direction by the universal adjustment realized by the universal adjusting knob. At least one printing head holder is coupled to a front portion of the universal adjusting mechanism and has a bottom coupled to a printing head, whereby the printing head holder is subjected to adjustment of pressure in upward-onward direction by the pressure adjusting knobs of the pressure regulation seat and is also subjected to fine adjustment of inclination direction by the adjustment that the universal adjusting knob applies to the universal adjusting mechanism to effect universal fine adjustment for the printing head holder and the printing head in order to ensure tight engagement of the printing head with respect to the label sheet of the barcode printer. Thus, a label sheet positioning device featuring universal fine adjustment of inclination direction is provided.

The effectiveness of the label sheet positioning device of the present invention is that a barcode printer is provided with a pressure adjusting mechanism that effects universal fine adjustment so that the barcode printer is not subjected to constrain caused by the width of a label sheet, whereby the tight engagement of the label sheet with respect to the printing head can be adjusted in a universal adjustable manner to ensure printing quality of the label sheet. Further, there is no need to make different pressure adjusting mechanisms for various width dimensions of the label sheet. The manufacturing costs of the barcode printer are reduced and the industrial utilization of the present invention is enhanced.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
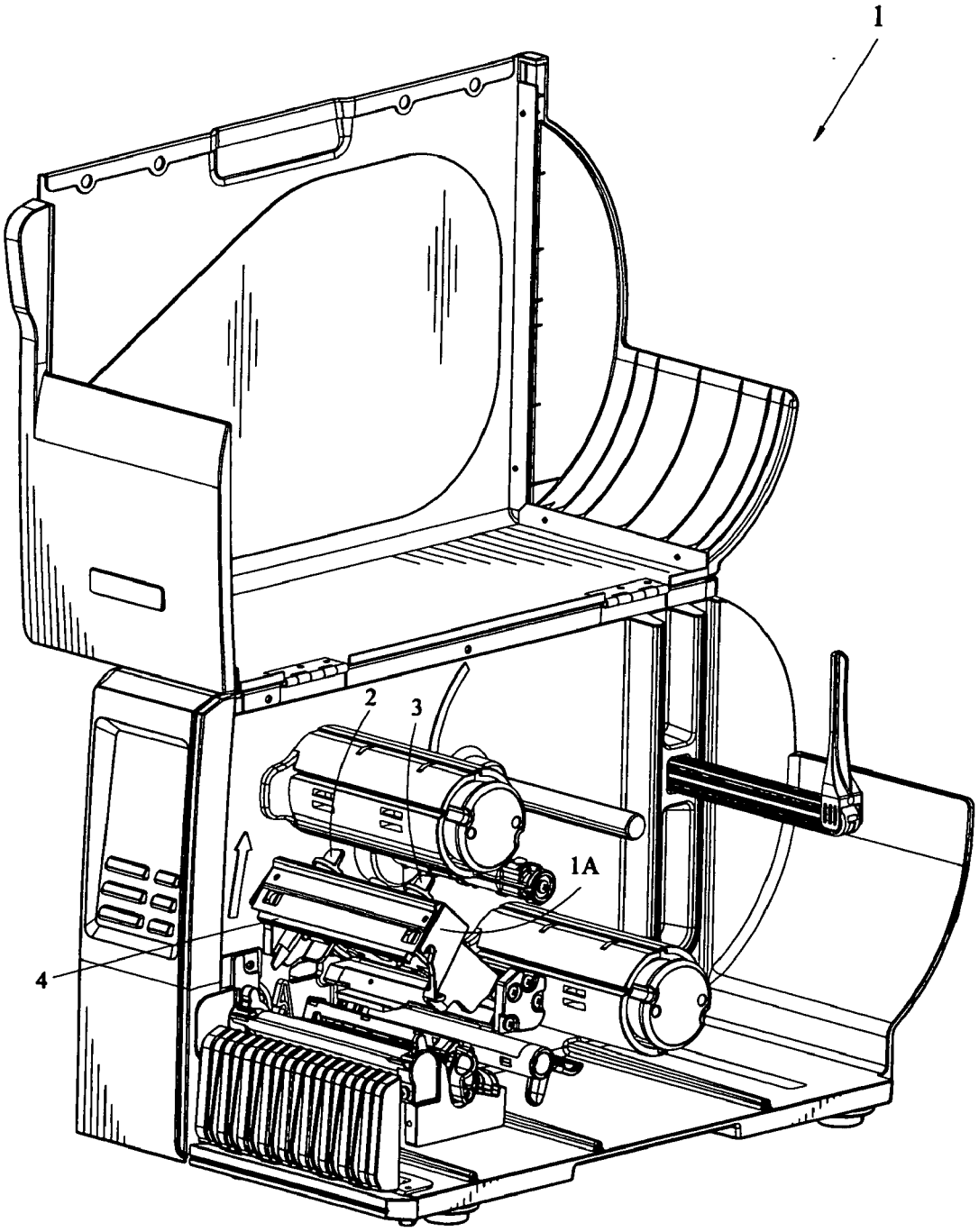
FIG. 1 is a perspective view of a conventional label sheet positioning device for a barcode printer.
Figure 2:
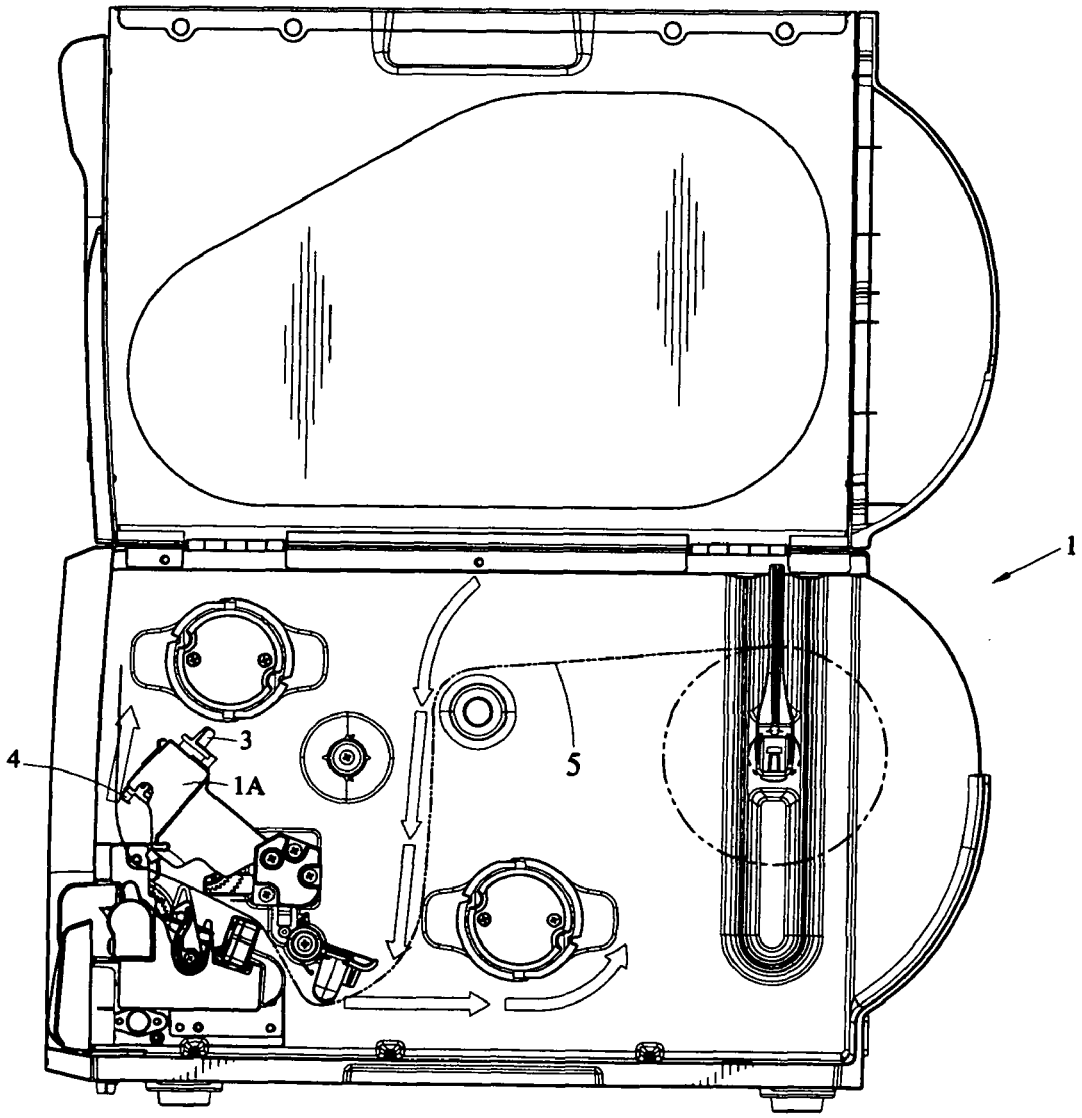
FIG. 2 is a side elevational view of FIG. 1.
Figure 3:
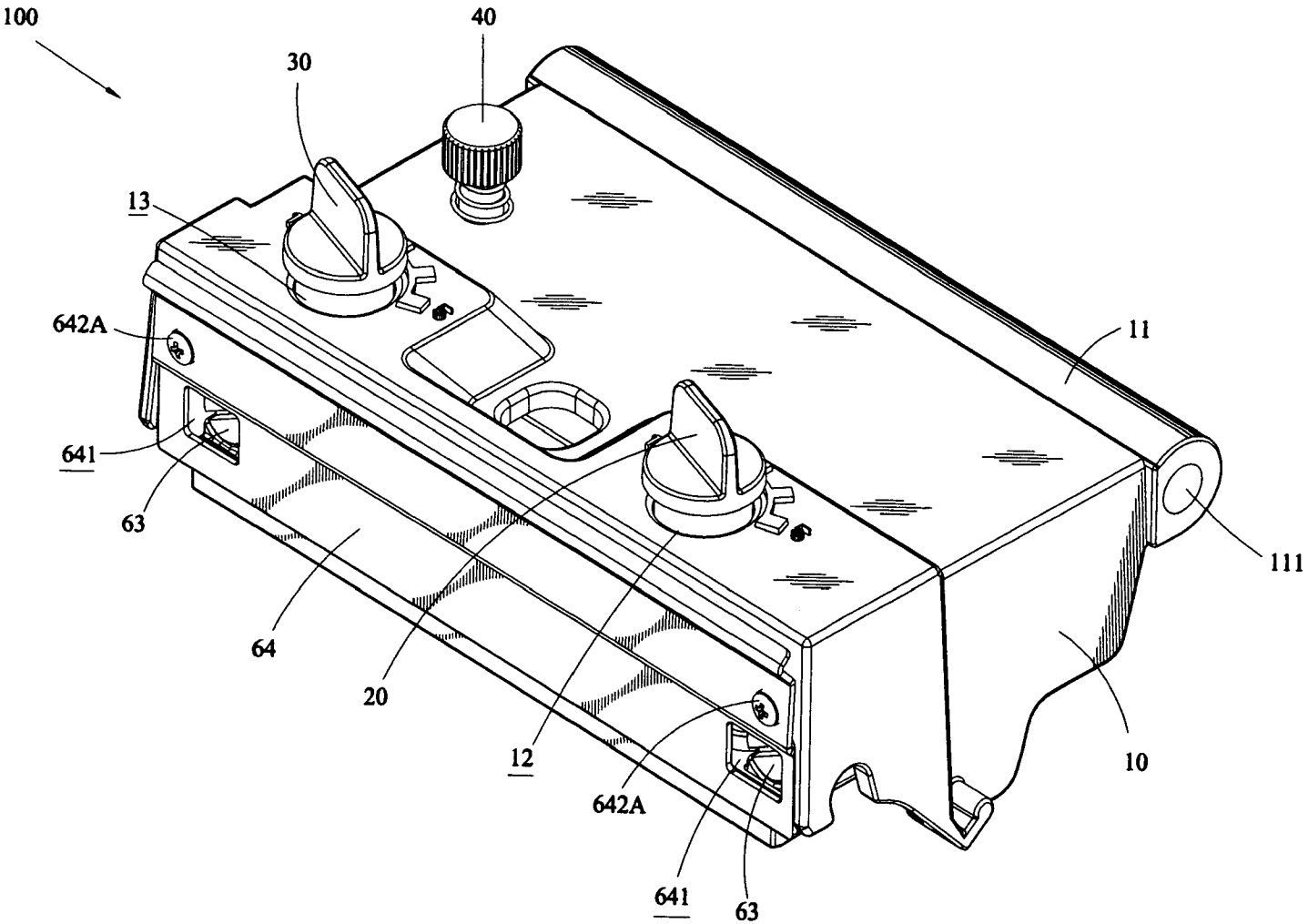
FIG. 3 is a perspective view of a label sheet positioning device constructed in accordance with the present invention for a barcode printer.
Figure 4:
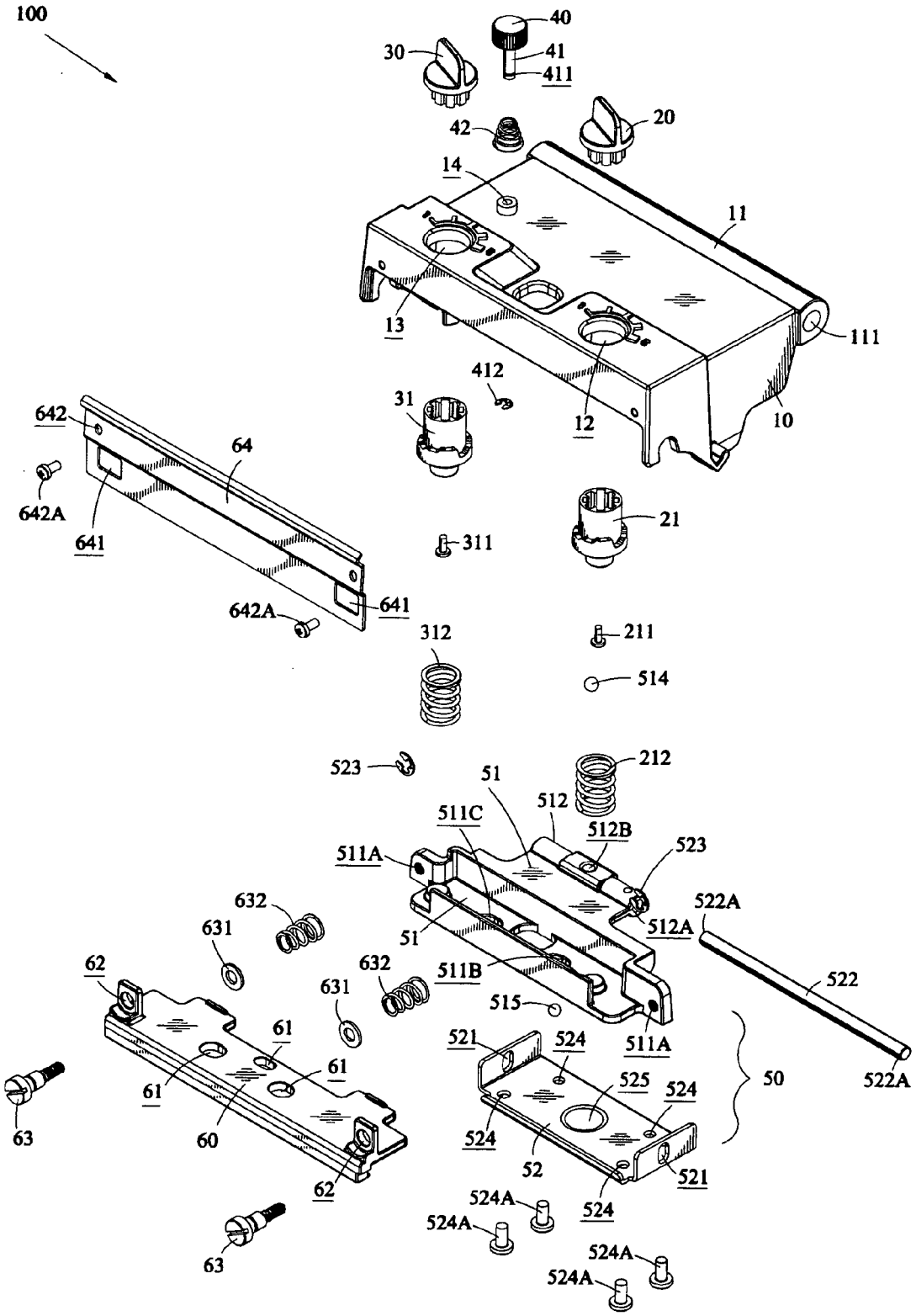
FIG. 4 is an exploded view of the label sheet positioning device in accordance with the present invention.
Figure 5:
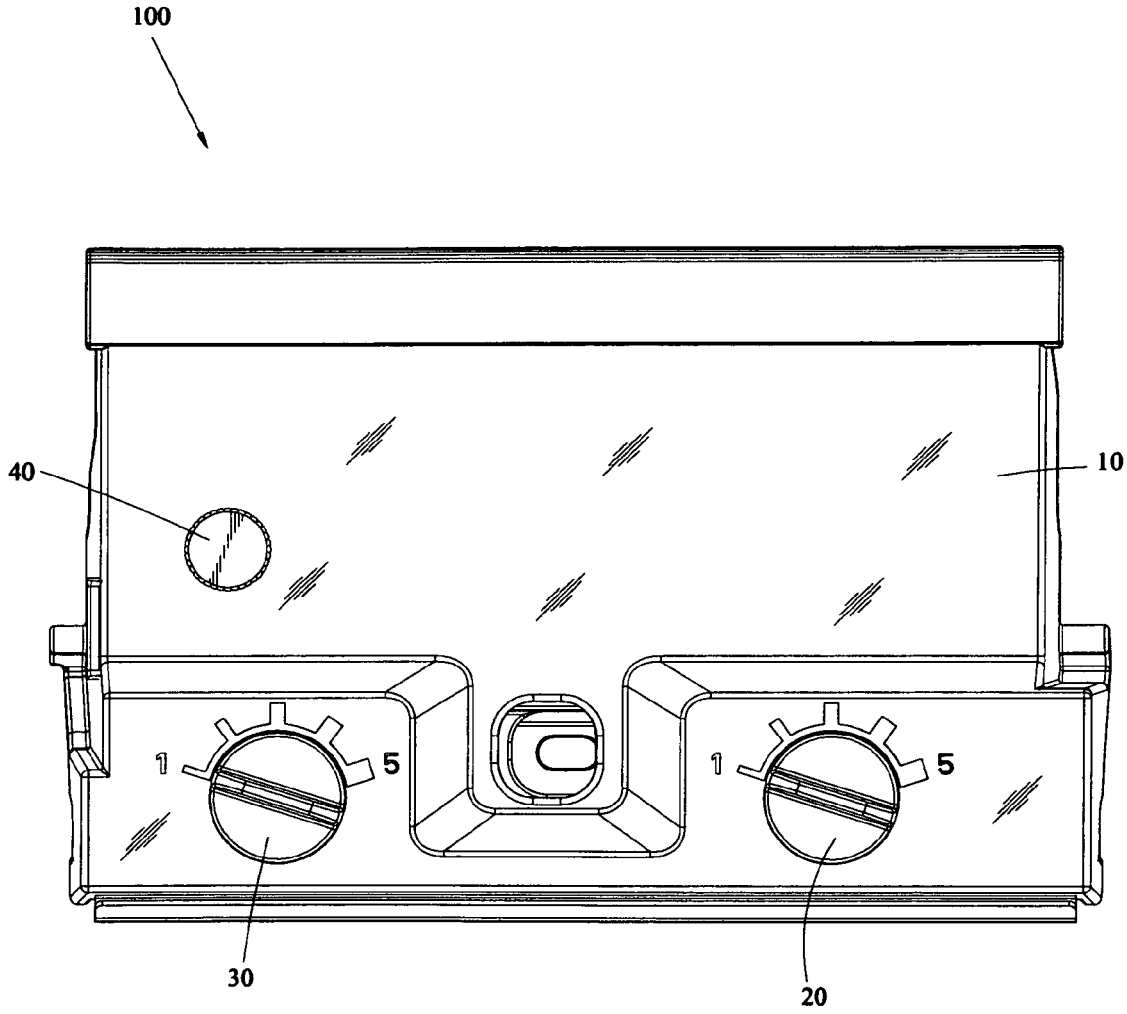
FIG. 5 is a top plan view of the label sheet positioning device of the present invention.
Figure 6:
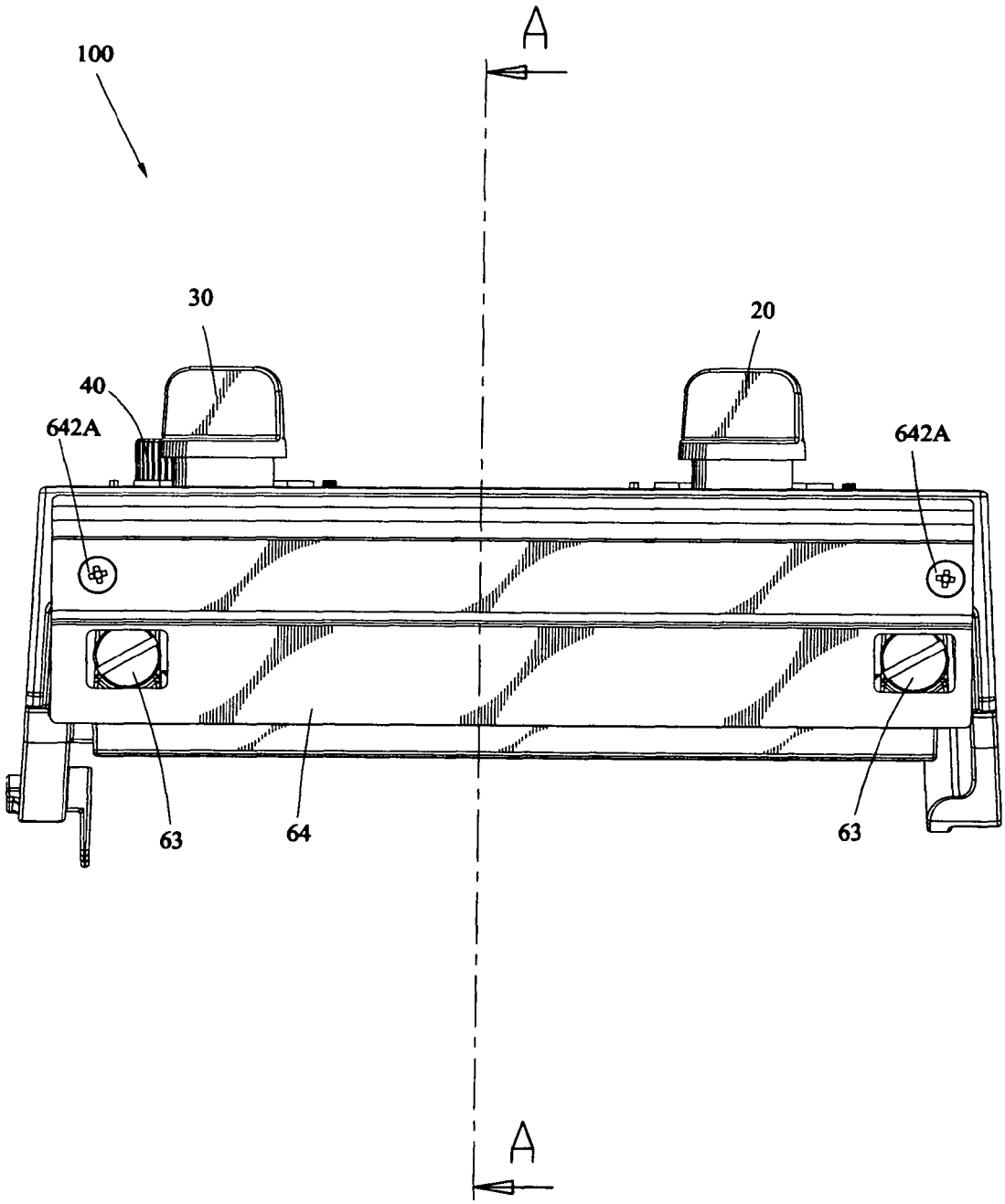
FIG. 6 is a front view of the label sheet positioning device of the present invention is embodied.
Figure 7:
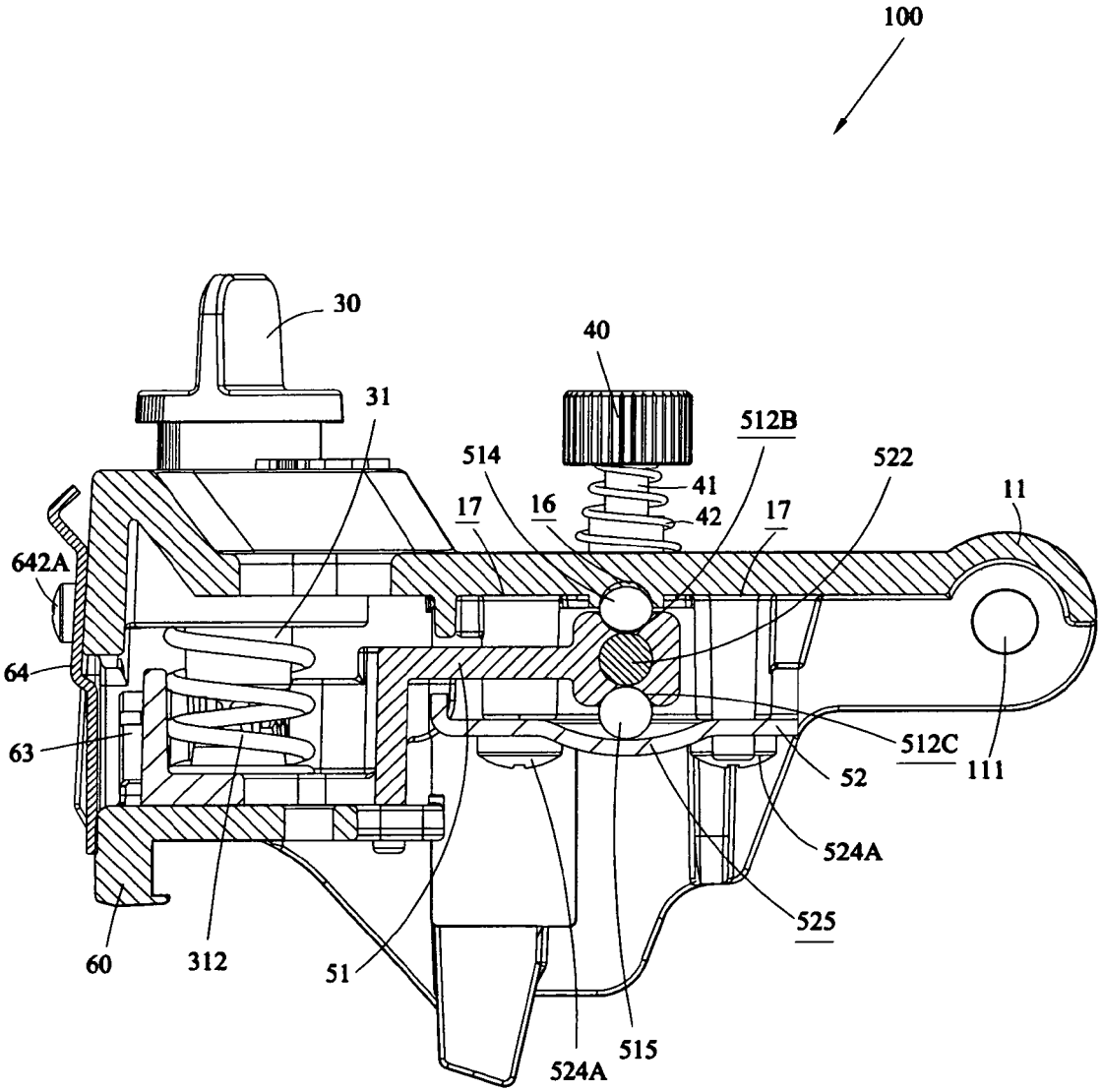
FIG. 7 is a cross-sectional view taken along line A-A' of FIG. 6.
Figure 8:
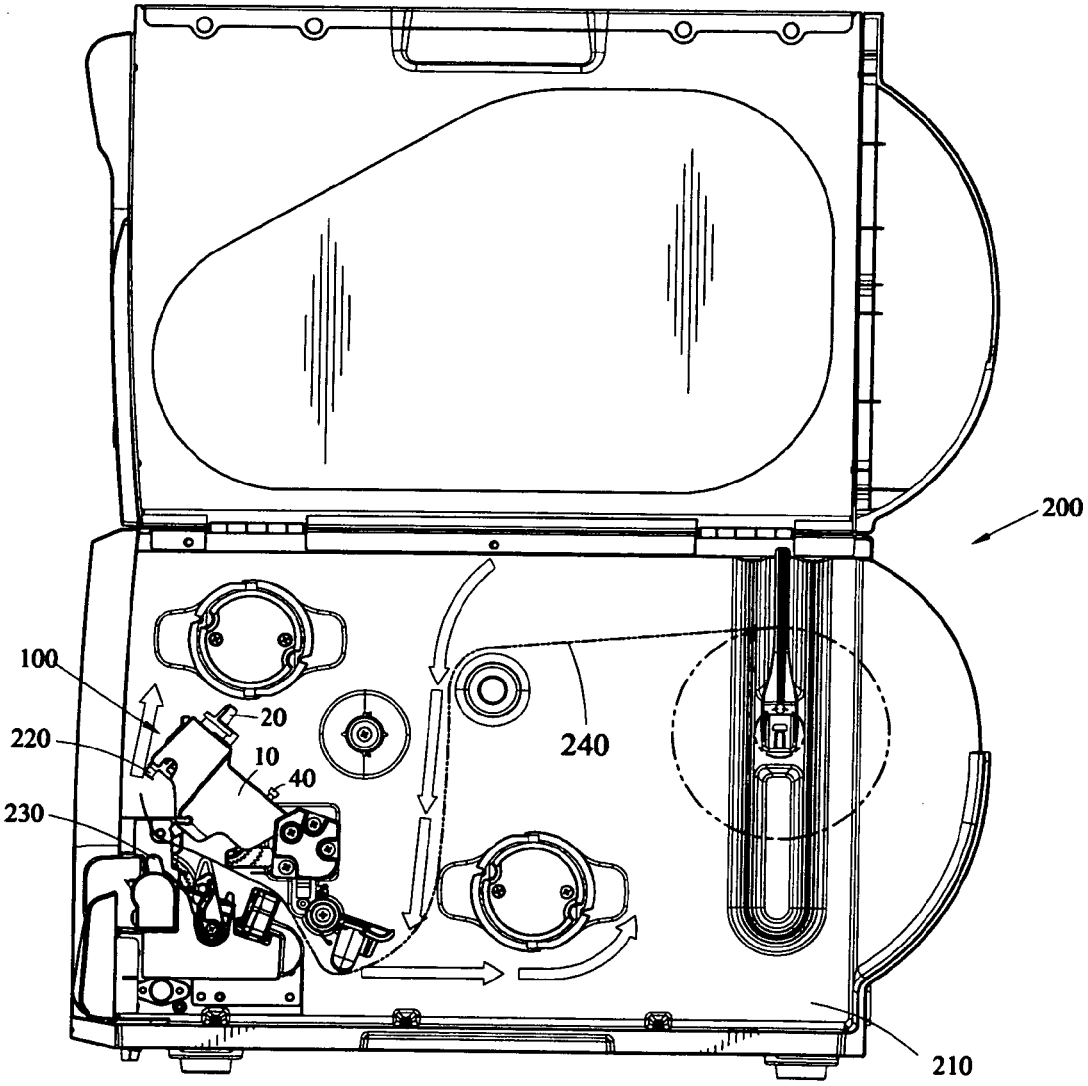
FIG. 8 schematically illustrates an application of the label sheet positioning device of the present invention in a barcode printer.
Figure 9:
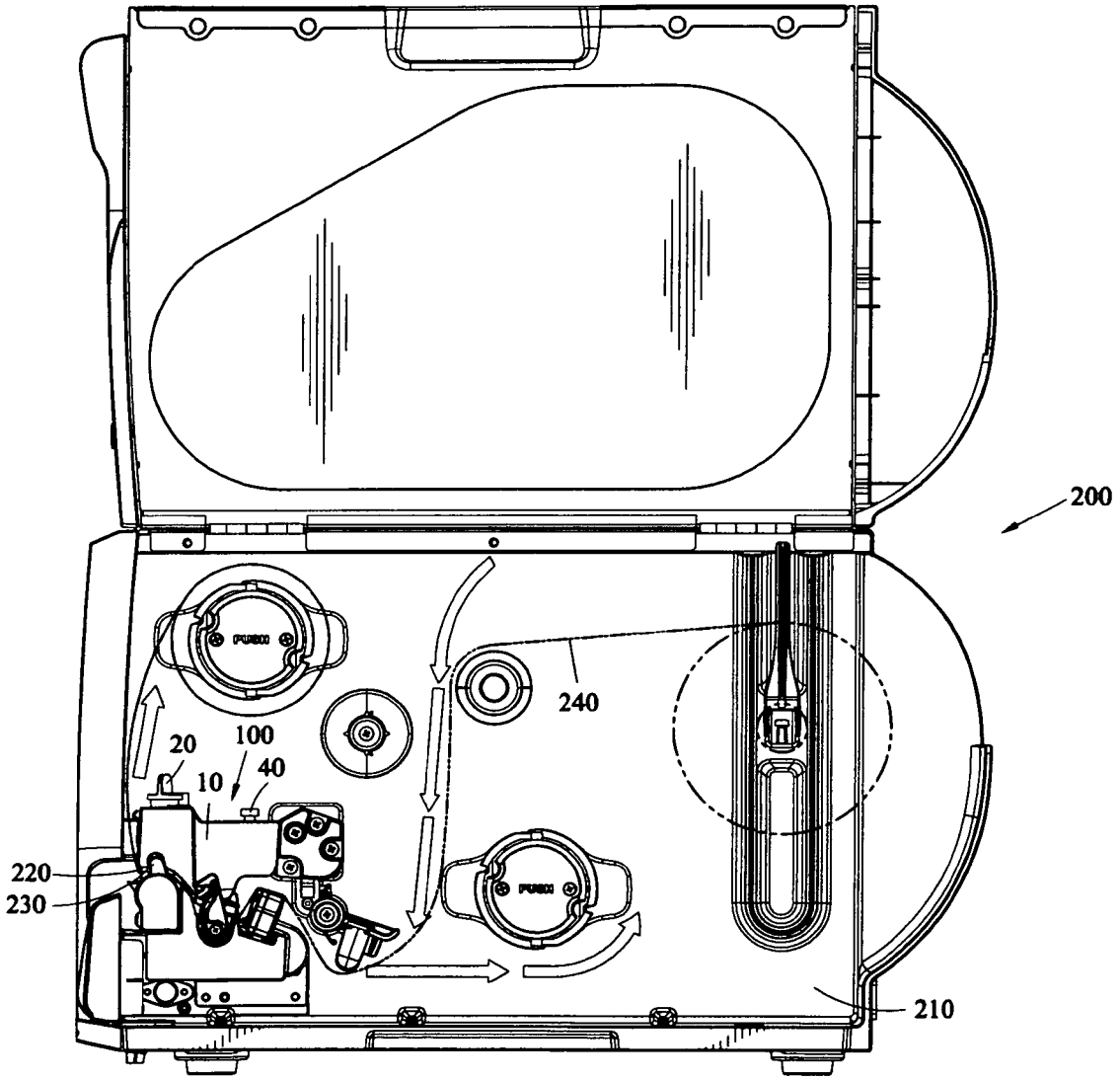
FIG. 9 is a view similar to FIG. 8 but illustrating the label sheet positioning device downward closed onto a label sheet hold-down axle in a lower portion of the barcode printer.

With reference to the drawings and in particular to FIGS. 1-6, a label sheet positioning device constructed in accordance with the present invention, generally designated at 100, is provided for a barcode printer 200 (FIG. 8). The label sheet positioning device 100 comprises a pressure regulation seat 10 having a rear end forming a pivoting section 11, which is coupled to an enclosure 210 of the barcode printer 200 through a shaft 111 (also see FIG. 7), so that the pressure regulation seat 10 is rotatable frontward/rearward for opening/closing. The pressure regulation seat 10 has a top face in which a pair of adjusting-knob holes 12, 13 and at least one fine adjustment mounting hole 14 are defined. The pressure regulation seat 10 has a front face in which a plurality of fastening holes 15 is defined. The pressure regulation seat 10 also has a bottom face in which at least one recess 16 and a plurality of internally-threaded holes 17 (see FIG. 6) are defined.

The adjusting-knob holes 12, 13 respectively functions to receive and couple pressure adjusting knob 20, 30. A lower end of the pressure adjusting knob 20 is fit to a depressing/contacting bar 21, which is secured to the pressure adjusting knob 20 by a bolt 211. A spring 212 is fit onto a lower end of the depressing/contacting bar 21 so that the pressure adjusting knob 20 features resilient downward depression and upward springing to effect pressure regulation. A lower end of the pressure adjusting knob 30 is fit to depressing/contacting bar 31, which is secured to the pressure adjusting knob 30 by a bolt 311. A spring 312 is fit onto a lower end of the depressing/contacting bar 31 so that the pressure adjusting knob 30 features resilient downward depression and upward springing to effect pressure regulation.

The fine adjustment mounting hole 14 of the pressure regulation seat 10 is coupled with a universal adjusting knob 40, which has a lower end forming a bar 41 having an end around which a retention groove 411 is circumferentially formed. A spring 42 is fit over the bar 41. The bar 41 extends through the fine adjustment mounting hole 14 and a C-clip 412 is mounted to the retention groove 411 to thereby secure the universal adjusting knob 40 in the fine adjustment mounting hole 14 and allow the universal adjusting knob 40 to feature resilient downward depression and upward springing through rotation to effect fine adjustment and regulation of pressure.

At least one universal adjusting mechanism 50 comprises an adjustment seat 51 and a base 52. The adjustment seat 51 has a front portion forming a coupling section 511 on opposite ends of which two internally threaded hole 511A are respectively formed. The adjustment seat 511 has a bottom on which two depression joint sections 511B, 511C are formed in such a way that the depression joint section 511B receives depression fitting of the lower end of the depressing/contacting bar 21 of the pressure adjusting knob 20 and the depression joint section 511C receives depression fitting of the lower end of the depressing/contacting bar 31 of the pressure adjusting knob 30. Thus, the pressure adjusting knobs 20, 30 can effect resilient downward depression and/or upward springing by means of rotation to adjust the spacing and pressure exerting between the adjustment seat 51 of the universal adjusting mechanism 50 and the pressure regulation seat 10. The adjustment seat 51 has a rear end forming a universal rotation section 512, which has a front end engageable by a tip end of the bar 41 on the lower side of the universal adjusting knob 40, whereby rotation of the universal adjusting knob 40 can effect resilient downward depression and/or upward springing for adjusting universal adjustment pressure and directional vectors of the adjustment seat 51.

The universal rotation section 512 has a rear end forming a shaft bore 512A. The universal rotation section 512 forms a hole 512B, 512C on the portions upward and downward of the shaft bore 512A for respectively receiving therein a ball 514, 515. An upper portion of the ball 514 is fit in the recess 16 that is defined in the bottom face of the pressure regulation seat 10 so that universal rotation can be realized between the pressure regulation seat 10 and the adjustment seat 51 of the universal adjustment mechanism 50.

Opposite ends of the base 52 respectively form holes 521 in alignment with the shaft bore 512A of the universal rotation section 512. A shaft 522 extends through the holes 521 and the shaft bore 512A. Opposite ends of the shaft 522 form circumferential grooves 522A receiving C-clips 523 for retaining the shaft 522 in the holes 521 and the shaft bore 512A.

The base 52 has a bottom forming a plurality of fastening holes 524 and at least one recess 525. Each fastening hole 524 is provided with a bolt 524A that extends through and is fastened to the internally-threaded holes 17 defined in the bottom face of the pressure regulation seat 10. The recess 525 serves to partially receive and engage a lower portion of the ball 515 that is received in the hole 512C in the bottom portion of the universal rotation section 512 so that the adjustment seat 51 is interposed between and enclosed by the pressure regulation seat 10 and the base 52. The balls 514, 515 received in the holes 512B, 512C defined in the upper and lower portions of the universal rotation joint 512 thus provide multiple-axis universal adjustment means for three-dimensional coordinates.

At least one printing head holder 60 has a bottom defining a plurality of holes 61 for mounting a printing head 220 (see FIG. 7). The printing head holder 60 has a front portion forming, in opposite ends thereof, two through holes 62 for each receiving a bolt 63 extending also through a washer 631. Ends of the bolts 63 are fit through spring 632 and engage the internally-threaded holes 511A defined in the front portion of the adjustment seat 51 so that the bolts 63 provide the function of adjusting the spacing and pressure for frontward-rearward mounting to the adjustment seat 51. With the coupling to the adjustment seat 51, the printing head holder 60 and the printing head 220 can perform universal adjustment in accordance with the universal adjustment realized by the adjustment 51 with respect to the pressure regulation seat 10 and the base 52.

The front portion of the printing head holder 60 is mounted with a panel 64 having opposite ends forming an adjusting opening 641 and a through hole 642 respectively. The adjusting openings 641 correspond to two bolts 63 so that the bolts 63 can be adjusted through the adjusting openings 641. The holes 642 correspond to the fastening holes 15 defined in the front face of the pressure regulation seat 10 to receive bolts 642A for fixing the panel 64 to the pressure regulation seat 10.

Also referring to FIGS. 7 and 8, application and operation of the label sheet positioning device 100 of the present invention are illustrated. The pressure regulation seat 10 is rotatably mounted to the enclosure 210 of the barcode printer 200 through the pivoting section 11 and the shaft 111 so as to be depressible onto a label hold-down axle 230 (see FIG. 8) on a lower portion of the barcode 200. A label sheet 240 of the barcode 200 is fed through between the printing head 220 and the label hold-down axle 230. Under this situation, the universal adjusting knob 40 is operated to effect resilient depression and/or upward springing in accordance with the width/size of the label sheet 240, whereby the adjustment seat 51 of the universal adjusting mechanism 50 synchronously cause the printing head holder 60 and the printing head 220 to effect universal adjustment, of which an angular range is restricted by the extension of the opposite ends of the shaft 522 beyond the holes 521 of the base 52 by which fine adjustment can be realized. Certainly, the angular range of the universal adjustment can be varied in accordance with the change of the width/size of the label sheet 240 or the angular range can be completely removed. With such a universal adjusting function provided above for the printing head 220, the printing head 220 can be used for various applications in which label sheets 240 of different widths/sizes are used to ensure close engagement between the printing head 220 and the label sheet 240 and also enhance the printing quality of the label sheet 240.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A label sheet positioning device for a barcode printer comprising:

a pressure regulation seat rotatably mounted to an enclosure of the barcode printer to be selectively downward closed onto a label sheet hold-down axle of the barcode printer or upward moved to disengage from the label sheet hold-down axle, the pressure regulation seat having a top to which two pressure adjusting knobs and at least one universal adjusting knob are movably mounted;

at least one universal adjusting mechanism adjustably coupled to the pressure regulation seat and being subjected to resilient depression/upward springing effected by the pressure adjusting knobs to adjust pressure in upward-downward direction and being further subjected to universal adjustment of displacement direction and angle effected by the universal adjusting knob;

at least one printing head holder coupled to the universal adjusting mechanism, the printing head holder having a bottom coupled to a printing head of the barcode printer, whereby with the universal adjustment effected by the universal adjusting mechanism, the printing head is set in close engagement with a surface of a label sheet of the barcode printer; and, a C-clip mounted to the retention groove;

wherein the universal adjusting knob has a lower end forming a bar, and the bar has an end around which a retention groove is circumferentially formed.

2. The label sheet positioning device as claimed in claim 1, wherein the top of the pressure regulation seat forms two adjusting knob holes for coupling the pressure adjusting knobs.

3. The label sheet positioning device as claimed in claim 1, wherein the top of the pressure regulation seat forms at least one fine adjustment mounting hole for coupling the universal adjusting knob.

4. The label sheet positioning device as claimed in claim 1, wherein the pressure regulation seat has a front face in which a plurality of fastening holes is defined.

5. The label sheet positioning device as claimed in claim 1, wherein the pressure regulation seat has a bottom face in which at least one recess is defined.

6. The label sheet positioning device as claimed in claim 1, wherein the pressure regulation seat has a bottom face in which a plurality of internally-threaded holes is defined.

7. The label sheet positioning device as claimed in claim 1, wherein each pressure adjusting knob has a lower end coupled to a depressing/contacting bar.

8. The label sheet positioning device as claimed in claim 7, wherein the depressing/contacting bar has a lower end to which a spring is fit.

* * * * *